United States Patent [19]

Gurries

[11] 4,229,046

[45] Oct. 21, 1980

[54] TOOL DRIVING APPARATUS AND METHOD

[75] Inventor: Raymond A. Gurries, Reno, Nev.

[73] Assignee: The Gurries Company, Sparks, Nev.

[21] Appl. No.: 973,161

[22] Filed: Dec. 26, 1978

Related U.S. Application Data

[63] Continuation-in-part of Ser. No. 873,249, Jan. 30, 1978, abandoned.

[51] Int. Cl.[2] ..... E21C 37/20; E01C 23/09

[52] U.S. Cl. ..... 299/37; 299/14; 37/DIG. 18; 172/40; 173/49; 173/100

[58] Field of Search ..... 299/14, 37; 173/49, 173/100, 139; 172/40; 37/DIG. 18

[56] References Cited

U.S. PATENT DOCUMENTS

| | | | |
|---|---|---|---|
| 3,437,381 | 4/1969 | Bodine | 299/37 |
| 3,527,501 | 9/1970 | Shatto | 299/37 |
| 3,633,683 | 1/1972 | Shatto | 173/49 |
| 3,770,322 | 11/1973 | Cobb et al. | 299/37 |
| 4,003,603 | 1/1977 | Stemler | 299/37 |

*Primary Examiner*—Ernest R. Purser

*Attorney, Agent, or Firm*—Townsend and Townsend

[57] ABSTRACT

A sonic generator produces a reciprocating force that is transmitted to a tool by a resonant or nonresonant force transmitting member having an output that reciprocates about a neutral position responsive to the force of the sonic generator. A continuous unidirectional force is applied to the sonic generator by a tool carrier. The tool advances intermittently along a work path through a medium responsive to the continuous unidirectional force and the reciprocating force. A gap is held between the neutral output position of the transmitting member and the tool when the tool is unable to advance through the medium responsive to the continuous unidirectional force and the reciprocating force. Specifically, the force of the sonic generator is sufficiently large relative to the unidirectional force to overcome the latter, and to drive the tool holder back away from the tool when the tool is unable to advance along the work path, thereby establishing a protective gap. When the force transmitting member is resonant, cessation of resonance is prevented when the tool encounters an immovable object by establishing the protective gap in the described manner.

6 Claims, 6 Drawing Figures

TOOL DRIVING APPARATUS AND METHOD

CROSS REFERENCE TO RELATED APPLICATIONS

This application is a continuation-in-part of my copending application Ser. No. 873,249, filed Jan. 30, 1978 and now abandoned, the disclosure which is incorporated fully herein by reference.

BACKGROUND OF THE INVENTION

The present invention relates generally to power driving mechanisms for tools and, more particularly, to apparatus and a method for driving tools of various types into earth, coal, wood, concrete, asphalt or other materials or substances.

Various forms of power sources, mechanical, hydraulic, pneumatic or others, have been used to drive tools for various purposes, for example, digging coal, cutting trees, driving piles, pavement removal, earth working, and various agricultural operations. The specific tool is designed for the particular job.

Recently, a power source has been developed employing a resonant vibration system driven by a sonic generator, an example being shown and described in U.S. Pat. No. 3,367,716. While the resonant vibration principle has merit in that considerable force can be generated, the proper transfer of such force to the material has proved extremely difficult to accomplish. The sonic generator is mounted on a tool holder or carrier that is driven by a continuous unidirectional force. A resonant force transmitting beam couples the sonic generator to a tool that is advanced intermittently along a work path responsive to the continuous unidirectional force and the force of the sonic generator. When the tool encounters an immovable object, i.e., an object that the oscillator force is unable to overcome, destruction of the tool driving apparatus has been experienced.

SUMMARY OF THE INVENTION

A sonic generator produces a reciprocating force that is transmitted to a tool by a resonant or nonresonant force transmitting member having an output that reciprocates about a neutral position responsive to the force of the sonic generator. A continuous unidirectional force is applied to the force transmitting member. The tool advances intermittently along a work path through a medium responsive to the continuous unidirectional force and the reciprocating force. According to the invention, a gap is held between the neutral output position of the force transmitting member and the tool when the tool is unable to advance through the medium responsive to the continuous unidirectional force and the reciprocating force. The gap protects the tool driving apparatus from destruction.

In the preferred embodiment, the sonic generator and the force transmitting member are supported by a tool holder or carrier to which the continuous unidirectional force is applied. The reciprocating force produced by the sonic generator is substantially larger than the continuous unidirectional force applied to the tool holder. Specifically, the force of the sonic generator is sufficiently large relative to the unidirectional force to overcome the latter and to drive the tool holder back away from the tool when the tool is unable to advance along the work path, thereby establishing the protective gap.

In one aspect of the invention, which is applicable when the force transmitting member is resonant, cessation of resonance is prevented when the tool encounters an immovable object during application of the continuous unidirectional force and the force of the sonic generator. Preferably, although in the broadest form of the invention not necessarily, this is done in the manner described above.

BRIEF DESCRIPTION OF THE DRAWINGS

The features of a specific embodiment of the best mode contemplated of carrying out the invention are illustrated in the drawings, in which.

DETAILED DESCRIPTION OF THE SPECIFIC EMBODIMENT

Figure 1:
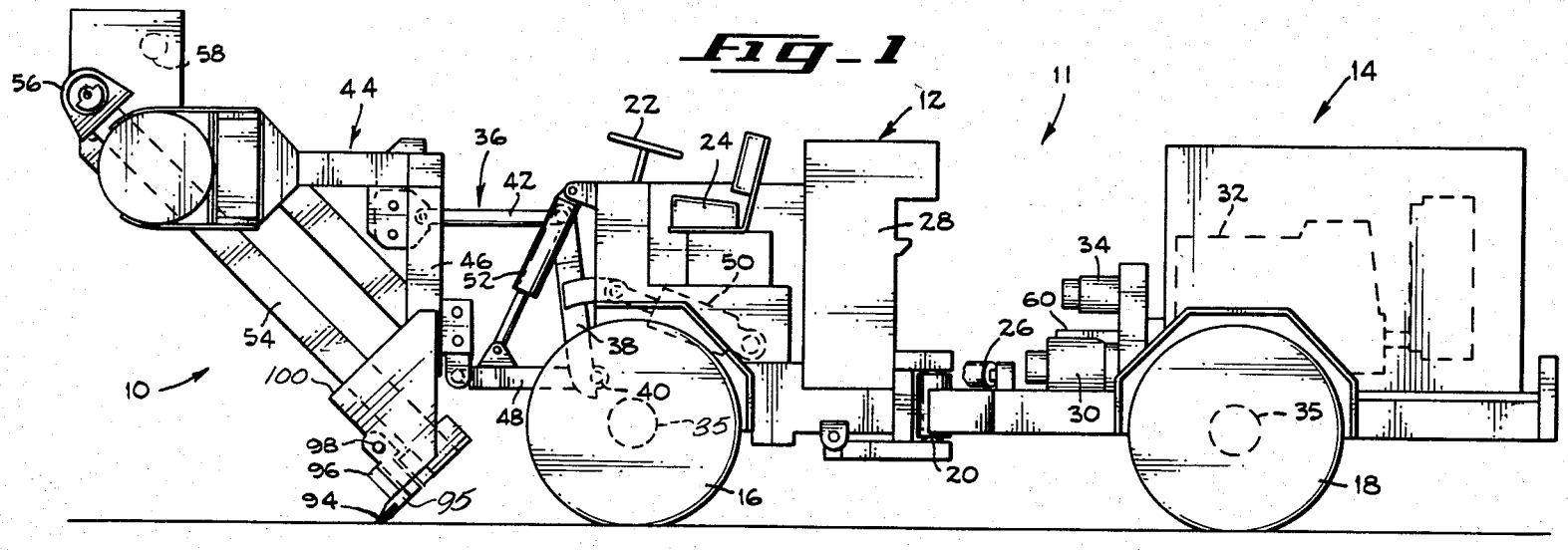
FIG. 1 is a side elevational view of tool driving apparatus embodying the present invention and especially arranged to cut or shear hard material such as asphalt or concrete.

It is the general objective of the present invention to provide apparatus for effectively applying driving force to a tool, such as a cutter, for rapidly shearing or cutting hard material such as a layer of concrete, asphalt, or other material from a roadway or similar surface, or to various other tools specific to a particular operation.

Specifically, and by way of example, the tool can take the form of a cutter blade having an elongated cutting edge arranged to engage concrete or other material to be removed at a controlled angle and at a controlled depth, and having a transverse disposition so that, upon energization, a swath of predetermined width can be simultaneously removed. The cutter blade is mounted from a powered and steered mobile frame for reciprocating motion, which mounting preferably constitutes a pivotal support for the cutter blade so that it moves arcuately first in a forward cutting direction and then rearwardly. The point of pivotal support is in advance of the cutting edge in the direction of cutting so that such pivotal motion is directed angularly downward into the material which is to be cut or severed, and at an angle which will vary dependent on the hardness and other mechanical properties of the material, and which can be adjusted to optimize the operation.

Force impulses are delivered cyclically to the pivotally supported cutter blade by reciprocating drive means, which on its forward stroke engages and drives the cutter blade into the material and thence withdraws preparatory to a subsequent driving stroke, forming a gap between the cutter blade and the drive means. Forward motion of a mobile supporting frame generates a tractive force which tends to close the gap in a fashion such that the reciprocating drive means is brought into contact with the cutter blade after the former's speed (and momentum) approaches a maximum in the forward or cutting direction. Thus, the drive means is in driving contact with the cutter blade itself for less than 180° of any given cycle.

The drive means takes the form of a resonant force transmitting member powered by a sonic generator or oscillator incorporating the general principles embodied in the unit shown and described in the aforementioned patent. However, the resonant member constitutes a generally upright beam mounted by a resilient tire at its upper node position to accommodate "pseudo-nodes" generated during operation. An additional rigid member engages the beam at its lower node position to support and maintain the desired beam disposition. The sonic generator is connected to the resonant beam at its upper end and preferably includes multiple eccentric weights mounted in spaced relation with a multiplicity of bearings on a common shaft so that the requisite force may be generated while minimizing the shaft diameter, and the peripheral speed and wear of the bearings because of the distribution of the bearing loads. The lower end of the beam lies adjacent the cutter blade to deliver the force impulses in substantial alignment with the cutting direction.

In accordance with the present invention, the input force generated by the sonic generator is greater than the described tractive force resultant from the forward motion of the powered mobile supporting frame, and as a consequence, there is no possibility for clamping of the beam end against the cutter blade (and the engaged material), which would stop the resonant actuation and permit the vibratory action of the sonic generator to be applied in a harmful fashion to itself and the supporting frame members.

Obviously, the same force imbalance principle can be applied to other tools such as mentioned, with the same critical and advantageous effect. In each case, however, it is important that the sonic generator provide an input force greater than that of a continuing tractive effect or its equivalent force tending to close the gap.

Figure 2:
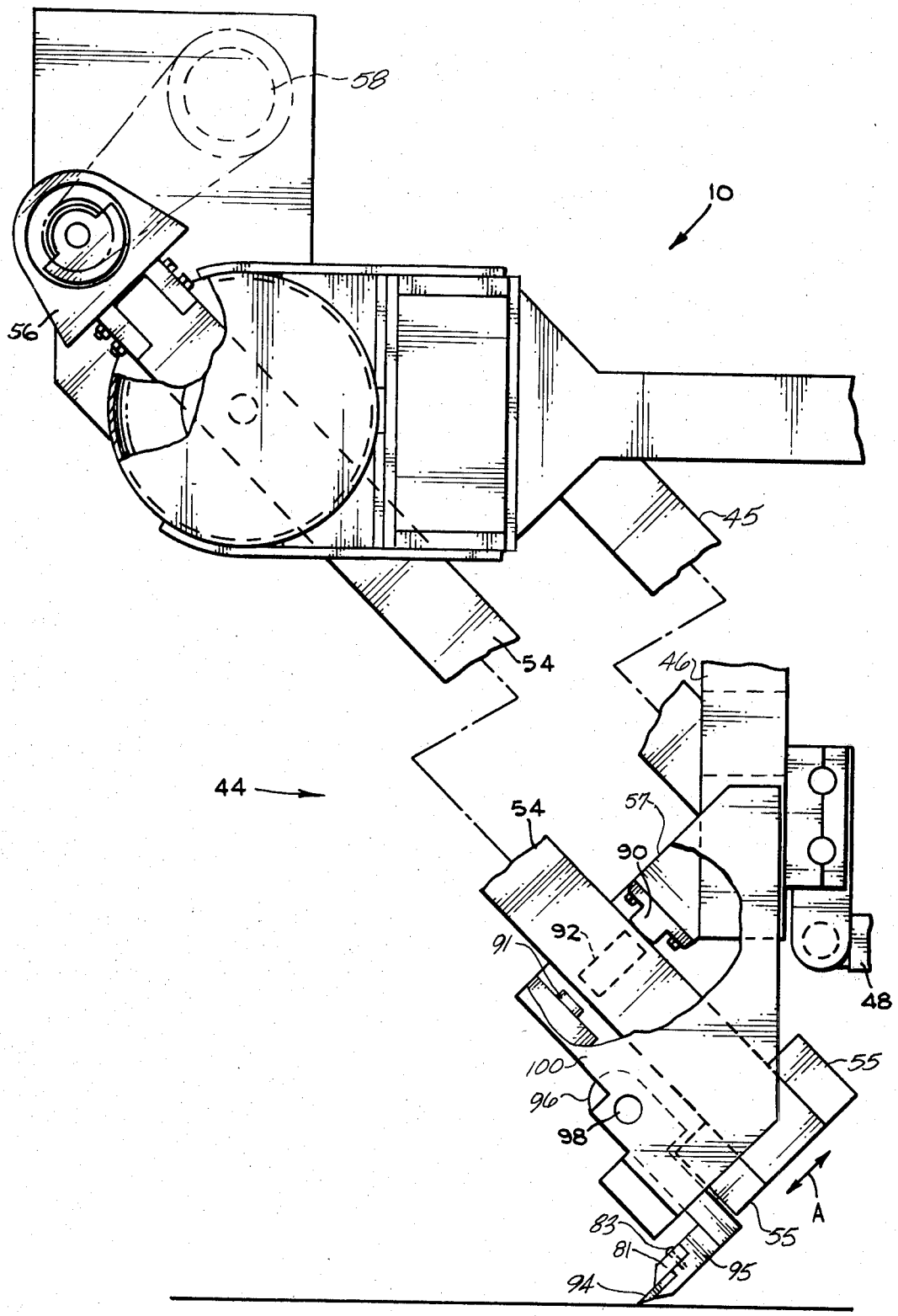
FIG. 2 is a fragmentary enlarged side view of the material cutting assembly of the apparatus with portions broken away to show interior details.

With initial reference to FIGS. 1 and 2, a material cutting assembly generally indicated at 10 is mounted at the front of a mobile carrier 11 which includes forward and rearward frame sections 12, 14, each supported by two rubber-tired wheels 16, 18, the two frame sections being connected by a vertical pivot pin 20 which enables articulation of the frame sections for purposes of steering.

A steering wheel 22 is mounted forwardly of a driver's seat 24 on the front section 12 of the frame and is arranged to energize, upon turning, a hydraulic ram 26 pivotally joining the frame sections 12, 14 so as to effect articulation thereof and consequent steering. A hydraulic pump 30 is mounted on the rear section 14 of the frame, and driven by an internal combustion engine 32. Fluid from a hydraulic reservoir 28 is driven by pump 30 through suitable hydraulic conduits (not shown) to hydraulic ram 26.

The engine 32 also drives a second hydraulic pump 34 which is hydraulically connected to hydraulic motors 35 to drive the wheels 16 on the front frame section 12 and the wheels 18 on the rear frame section 14, thus to provide motive power for the entire mobile carrier 11 in a generally conventional fashion. As will be understood, the motive power delivered to the wheels will urge the front-mounted cutting assembly 10 against material being cut with a certain tractive force which, for cutting a six-foot swath of concrete or asphalt, should vary for example between 5,000 and 60,000 pounds, depending upon the material resistance and vehicle speed. Assuming the weight of the vehicle and its load, i.e., material cutting assembly 10 and mobile carrier 11, is 75,000 pounds, the maximum tractive force, i.e., motive power delivered to the wheels, must be less than the weight of the vehicle and its load, e.g., about 60,000 pounds, to prevent slippage of wheels 16 and 18. As is well known in the art, the maximum tractive force of the vehicle depends upon the friction between the wheels and the surface on which it moves.

Material cutting assembly 10 is symmetrical about a center plane in the direction of movement, i.e., parallel to the plane of FIG. 1. Many of the elements on the right side of the center line, as viewed from the front, i.e., the left in FIG. 1, which are identified by unprimed reference numerals, have counterparts on the left side of the center line, which are identified by the same reference numerals primed.

In order to mount the mentioned material cutting assembly 10, a pair of laterally-spaced parallelogram units 36, 36' extend forwardly from the forward frame section 12. More particularly, the parallelogram units 36, 36' include an upstanding leg 38 pivotally connected at its lower extremity to the central portion of a fixed transverse shaft 40 on the front frame section 12 and pivotally joined at its upper extremity to the rear ends of forwardly projecting legs 42, 42'. These forwardly projecting legs 42, 42' are pivotally joined at laterally-spaced positions (see FIG. 2) to a generally triangular cutting assembly frame 44. For further details of cutting assembly frame 44, reference is made to my copending application entitled PAVEMENT PLANING METHOD AND APPARATUS, application Ser. No. 973,163, filed on even date herewith, the disclosure of which is incorporated fully herein by reference. Lower and outwardly curving legs 48, 48' are pivotally connected at their opposite extremities to the lower ends of the support beams 46, 46' and the previously described shaft 40, thus completing the two parallelogram units 36, 36'.

A powered hydraulic ram 50 is pivotally secured between the forward frame section 12 and the upright leg 38, of the parallelogram units 36, 36' to enable powered variation of the parallelogram disposition and accordingly the angular disposition of the cutting assembly 10. Additional powered hydraulic rams 52, 52' pivotally joined to the top of the frame section 12 and the lower generally horizontal legs 48, 48' of the parallelogram units 36, 36' enable substantially vertical adjustment of the cutting assembly.

The cutting assembly frame 44 supports a pair of resonant beams 54, 54' in the form of angularly upright parallel resonant beams composed of solid steel or other elastic material. Resonant beams 54, 54' are substantially parallel to struts 45, 45'. A sonic generator in the form of a pair of synchronized orbiting mass oscillators 56, 56' is secured by bolts or the like to the upper extremity of each resonant beam and generally incorporates the principles of an orbiting mass oscillator of the type shown in either U.S. Pat. No. 2,960,314 or U.S. Pat. No. 3,217,551. (The disclosures of these patents are incorporated fully herein by reference.) Orbiting mass oscillators 56, 56' are driven by a suitable hydraulic motor 58, that is energized through suitable hydraulic conduits (not shown) from a third hydraulic pump 60 driven by the previously described engine 32.

Energization of the exemplary embodiment illustrated provides a total peak energizing input force to the two resonant beams 54, 54' of 125,000 pounds in the form of sequential sonic oscillations at a frequency of approximately 100 cycles per second, i.e,. at or near the resonant frequency of resonant beams 54, 54'. Thus, the total force provided by oscillators 56, 56' is larger than the weight of the vehicle and its load. These force oscillations, delivered to the upper end of the beam, cause resonant vibration thereof through appropriate dimensional design of such beam at that frequency so that a corresponding cyclical reciprocal vibration at the lower end of the beam is derived, as shown by the arrow A in FIG. 2, preferably with a total peak-to-peak displacement of approximately one inch. Pairs of weights 55, 55' are attached, for example, by bolting, to the front and back of resonant beams 54, 54' at the lower end to increase the momentum thereof. Each resonant beam 54, 54' is designed and so driven that two vibration nodes are formed thereon inwardly from its opposite extremities, and its ends are free to vibrate, i.e., reciprocate, and in fact do vibrate. In summary, resonant beams 54, 54' are driven to form standing wave vibrations in their fundamental free-form mode. Each beam is carried from the cutting assembly frame 44 at its upper node position. However, the connection is resilient to allow for node variations (pseudo-nodes) during actual operation.

As shown in FIG. 2, at the lower node position, resonant beams 54, 54' are encompassed by rigid metal stop members 90, 90' at their rear, resilient rubber pads 91, 91' at their front, and pairs of resilient rubber pads 92, 92' at their sides. Pad pairs 92, 92' and pads 91, 91' comprise pieces of rubber vulcanized on metal mounting plates. Members 90, 90', pads 91, 91', and pad pairs 92, 92' are secured to the lower end of cutting assembly frame 44. When resonant beams 54, 54' are at rest, they lie on and are supported by pads 91, 91'. When resonant beams 54, 54' are resonating during operation of the apparatus, their lower node is driven up against stop members 90, 90' by the reaction of the material being worked upon as shown in FIG. 2, and remain in abutment with stop members 90, 90' during operation of the apparatus. Thus, stop members 90, 90' serve as rigid node supports for resonant beams 54, 54'. Stop members 90, 90' and pads 91, 91' are spaced sufficiently far apart to enable resonant beams 54, 54' to be shimmed to synchronize their transfer of force to the work tool. Specifically, shims are inserted between stop members 90, 90' and stop mounts 57, 57' so the lower extremities of resonant beams 54, 54' in their neutral position are both spaced precisely the same distance from the lever arms and cutter blade described below. Consequently, since oscillators 56, 56' run in phase and resonant beams 54, 54' reciprocate in phase, the lower extremities of resonant beams 54, 54' strike the cutter blade at the same time, i.e., in synchronism. As represented in FIG. 8 by the different thicknesses of shims 76, 76', stop members 90, 90' will in general have to be shimmed to a different degree to achieve the described synchronism, because of manufacturing tolerances. This is accomplished by the following procedure: first, one of the stop members is shimmed; second, the cutter blade is lowered into contact with the road surface; third, mobile carrier 11 is driven forward to rotate resonant beams 54, 54' about their upper node supports, until one of the resonant beams contacts its stop member at the lower node support; and fourth, the other stop member is shimmed until the other resonant beam contacts it. For more details about shimming stop members 90, 90' to synchronize resonant beams 54, 54', reference is made to my copending application Ser. No. 916,112, filed June 16, 1978.

As shown in FIG. 2, the material cutting assembly 10 includes a work tool which takes the form of an angularly-directed and transversely-extending cutter blade 94 held in a blade base 95. Cutter blade 94 and blade base 95 extend along the full width of the apparatus between beams 54, 54'. Cutter blade 94 is clamped to blade base 95 by a retaining bar 81 that is attached to blade base 95 by bolts 83. Lever arms 96, 96', are pivoted about substantially horizontal pivot pins 98, 98' on bracket pairs 100, 100'. Lever arms 96, 96' are attached, for example by welding, to the ends of blade base 95 near beams 54, 54'. It is to be particularly observed, as clearly shown in FIG. 2, that the cutting edge of the blade 94, when in material engagement, lies to the rear of the pivot pins 98, 98' so that any movement of the cutter blade 94 in a forward direction or to the left will be accompanied by a substantial downward force component and thus will result in penetration into the material being cut, without deflection of cutter blade 94 away from material engagement. Furthermore, because the pivotal support provides for a slight arcuate motion of the cutter blade 94, a slight additional separation of the layer of cut material from that lying therebelow will result. Thus, the cutter blade assembly comprising cutter blade 94, blade base 95, retaining bar 81, and lever arms 96, 96' is pivotally supported by brackets 100, 100' so it is adjacent to the lower extremity of the resonant beams 54, 54'. When the beams reciprocate, they drive the cutter blade assembly in a forward and downward direction or to the left, as shown in FIG. 2, and thereafter withdraw from contact with the cutter blade assembly in its cyclical displacement in the opposite or rearward direction. Thus, only unidirectional driving impulses are delivered to the cutter blade assembly in its forward direction, and in alignment with its cutting direction, so the cutter blade 94 advances with a chisel-like action.

Cutter blade 94 comprises a work tool that moves along the road surface, which comprises the work path. Cutting assembly frame 44 functions as a tool holder or carrier. Continuous unidirectional force is applied thereto by mobile carrier 11 in a direction parallel to the work path. Oscillators 56, 56' generate a reciprocating force, at least one component of which acts parallel to the work path. Each resonant beam 54, 54' comprises a force transmitting member, its upper extremity comprising an input to which the reciprocating oscillator force is applied, and its lower extremity comprising an output from which the reciprocating force is transferred to the tool. The tool advances intermittently along the work path responsive to the continuous unidirectional force applied by mobile carrier 11 and the reciprocating force applied by oscillators 56 and 56'.

For further details of the apparatus reference is made to my application entitled "Pavement Planing Method and Apparatus" Ser. No. 973,163.

When the beams 54, 54' withdraw from contact with the cutter blade 94 during resonant vibration, a momentary gap is formed which will remain until a repeated forward motion of the beams 54, 54'. To maximize the cutting force, it has been found that contact of the beams with the cutter blade preferably is made in the region where maximum forward velocity (and momentum) of the beams is approached in the forward (cutting) direction. Since the cutter blade 94 is in engagement with material to be cut, the adjacent beam is urged forwardly relative thereto, thus to close the momentary gap at the appropriate time of the resonant cycle.

This action, which is important to the effective cutting of concrete, asphalt, and other hard materials, can be explained more readily by reference to FIGS.

3A—3C wherein the various operational dispositions of the cutter blade 94 and the resonant beams 54, 54' are diagrammatically illustrated in somewhat exaggerated form for purposes of explanation.

Figure 3C:
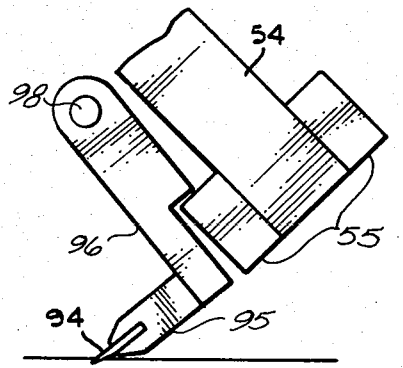
FIGS. 3A–3C are diagrammatic views of the tool and its drive mechanism in different stages of operation.
Figure 3B:
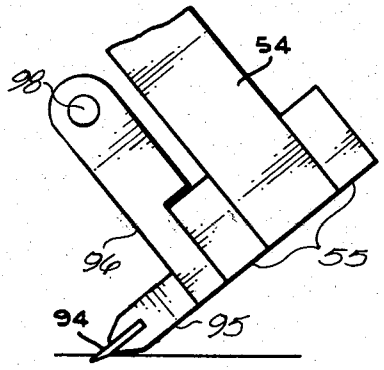
Figure 3A:
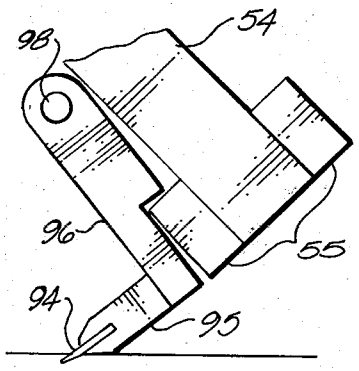
Figure 4:
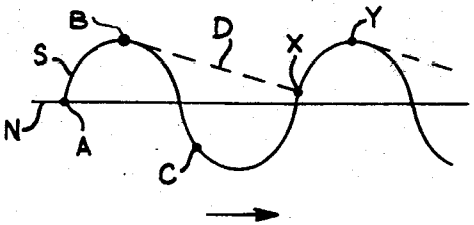
FIG. 4 is a graph showing the relationship of time and displacement of the tool and drive mechanism in the various operational stages shown in FIGS. 3A–3C.

In the time-displacement graph of FIG. 4, the abscissa N represents the neutral position of beams 54, 54', sinusoidal waveform S represents the reciprocating displacement of the beam outputs about their neutral position as a function of time, and the dashed line represents the position of the tool, i.e., cutter blade 94, relative to frame 44 as a function of time. For maximum force transfer, it is desirable for the beams to strike the tool when the beam outputs are traveling at maximum forward velocity, i.e., at the neutral position of the beam outputs. The neutral position of the beam outputs is their position when at rest, i.e., not resonating or being deflected, while the beam is in operating position, i.e., pivoted into abutment with stop member 90. During operation, as beams 54, 54' resonate, when the beam outputs are at their neutral position, which is represented by point A in FIG. 4, a small momentary gap typically exists between beams 54, 54', and the back surface of lever arms 96, 96', as illustrated in FIG. 3A. As the beam outputs move slightly forward from their neutral position toward the tool, they simultaneously strike the tool and drive it forward to perform the desired work, i.e., cutting through the concrete or asphalt road surface. The beam outputs remain in contact with the tool, as illustrated in FIG. 3B, until the beam outputs reach the forward extremity, i.e., peak, of their reciprocating excursion, which is represented by point B in FIG. 4. This is approximately slightly less than 90° of the beam reciprocation cycle. As the beam outputs begin to move in a rearward direction on their reciprocating excursion, a momentary gap is formed between the beam outputs and the tool, which is represented by the distance between lines D and S in FIG. 4. The continuous forward movement of frame 44 with mobile carrier 11, while the tool is held stationary by engagement with the road surface, reduces the distance between the tool and the neutral position of the beam outputs, which is represented in FIG. 4 by the slope of line D toward line N. When the beam outputs are moving in a rearward direction, beams 54, 54' are spaced from lever arms 96, 96' as illustrated in FIG. 3C. The momentary gap between the tool and the beam outputs is maximum at a point of their reciprocating excursion slightly before the rear extremity, which is represented by point C in FIG. 4. In summary, during each cycle of reciprocation of beams 54, 54', the beam outputs contact the tool during a short interval approaching 90° of the beam cycle, which is represented in FIG. 4 by the distance along waveform S between points X and Y. During the remainder of each cycle, the beam outputs are out of contact with the tool, which is represented in FIG. 4 by the distance along line D between points B and X. As previously indicated, the most efficient transfer of force from the beam outputs to the tool occurs with a contact interval approaching 90° of the beam cycle. To achieve this contact interval, the speed of mobile carrier 11 is adjusted accordingly to the stroke of the beam outputs, i.e., their peak to peak amplitude. The larger the stroke, the faster the speed of mobile carrier 11.

Cessation of resonance is prevented when the tool encounters an immovable object or unyielding material during the forward movement of mobile carrier 11. Specifically, a protective gap is established between the neutral position of the beam outputs and the tool when the tool is unable to advance along the work path responsive to the impulses transferred to it by beans 54, 54'. (This is to be distinguished from the momentary gap described above, which continuously opens and closes during normal operation through yielding material.) In the embodiment disclosed in this specification, the peak sonic force generated by oscillators 56, 56' is substantially greater than the maximum tractive force generated by mobile carrier 11, i.e., the weight of the vehicle and its load. Specifically, the sonic force is sufficiently large relative to the tractive force to enable the sonic force to overcome the tractive force and to drive the entire machine, including material cutting assembly 10 and mobile carrier 11, backwards away from the tool when the tool is unable to advance along the work path. In my application Ser. No. 973,187, filed on even date herewith, the disclosure of which is incorporated herein fully by reference, the protective gap is established in a different manner, namely, by a tool stop which prevents the beam output in its neutral position from contacting the tool when it encounters an immovable object. In either way, by thus establishing a protective gap between the beam output in its neutral position and the tool when it encounters an immovable object, cessation of resonance is prevented. It has been discovered that without such a protective gap, when the tool encounters an immovable object the beam output becomes clamped between the tool and the tool holder, thus terminating resonance and preventing transfer of the oscillator force to the tool. This is a common source of damage to the parts of the tool driving apparatus such as the resonant beam, the oscillator, or portions of the tool carrier. Thus, the gap protects the tool driving apparatus from destruction by an immovable object. The term "immovable object" as used in this specification is relative, not absolute; it is an object that hinders the advance of the machine sufficiently that, in the absence of the protective gap, the vehicle would drive the force transmitting member against the tool and would thus prevent the force transmitting member from transmitting the oscillations to the tool, with the result that the apparatus would destroy itself. In the case of a resonant force transmitting member or beam as described herein, when the output of the beams is clamped against the tool, the end of the beam is no longer free and becomes a node. The nodes thus shift and the entire mode of vibration changes, large vibrations now occurring at the oscillator and node supports, which destroys the node supports and/or the oscillator and beams.

Although the invention is illustrated in a machine for cutting concrete or asphalt road surfaces, it could be incorporated into any number of material working machines such as a coal planar, timber shearer, a bulldozer, a front end loader, a rock ripper, or a shovel bucket. In each case, an appropriate tool is employed. In the case of a shovel bucket, the continuous unidirectional force would be the closing force, i.e., line pull, of the bucket, which is continuous over the intervals of time in which the bucket is closing and is interrupted while the bucket is carrying its load from place to place. In general, the invention is applicable to any type of material working function wherein a tool is advanced through the material to perform the desired work. The invention can be practiced with other types of force transmitting members including resonant beams of other configurations, such as the angular configuration shown in my application Ser. No. 973,187, filed on even date herewith, or nonresonant members vibrating in a forced mode. In any case, the gap prevents the oscillator force from being transferred self-destructively back through the force transmitting member. Although it is preferable to practice the invention in apparatus employing "sonic rectification" as that term is used in Bodine U.S. Pat. No. 3,367,716, the invention is also applicable to apparatus in which the tool is attached to the force transmitting member, e.g., the resonant beams, as in Bodine U.S. Pat. No. 3,232,669.

Various modifications and/or alterations in the structure as described can be envisioned without departing from the spirit of the invention. Accordingly, the foregoing description of one embodiment is to be considered as purely exemplary and not in a limiting sense, and the actual scope of the invention is to be indicated only by reference to the appended claims.

What is claimed is:

1. A material working machine having a tool holder, a tool adapted to move freely relative to the tool holder along a work path, a resonant member supported by the tool holder, the resonant member having an output coupled to the tool and an input, means attached to the tool holder for applying an oscillatory, resonance causing force to the input of the resonant member for a given period of time, and means for applying a unidirectional force to the tool holder for the given period of time to advance the tool intermittently along the work path as the resonant member resonates, the oscillatory force being sufficiently larger than the maximum value of the unidirectional force to overcome the unidirectional force and to drive the resonant member back, thereby preventing cessation of resonance, when the tool is unable to advance responsive to the unidirectional force and the oscillatory force.

2. The machine of claim 1, in which the tool is movably attached to the tool holder and unattached to the resonant member and the resonant member has a neutral position about which it oscillates, whereby a gap is established between the neutral position of the output and the tool when the tool is unable to advance responsive the unidirectional force and the oscillatory force.

3. The machine of claim 2, additionally comprising means for movably attaching the tool to the tool holder so the output of the resonant member only applies the oscillatory force to the tool while the resonant member is oscillating on one side of its neutral position.

4. The machine of claim 1, in which the resonant member has one or more nodes where the resonant member is attached to the tool holder.

5. The machine of claim 1, in which the resonant member has first and second nodes between the input and the output where the resonant member is attached to the tool holder.

6. The apparatus of claim 1, in which the means for applying a unidirectional force comprises a wheeled, nonslipping motorized vehicle and the oscillatory force is larger than the weight of the vehicle and its load.

* * * * *